United States Patent [19]

Faust

[11] Patent Number: 4,653,821

[45] Date of Patent: Mar. 31, 1987

[54] DRAWER GUIDE

[75] Inventor: Karl-Volker Faust, Bielefeld, Fed. Rep. of Germany

[73] Assignee: Paul Hettich GmbH & Co., Kirchlenger, Fed. Rep. of Germany

[21] Appl. No.: 789,615

[22] Filed: Oct. 21, 1985

[30] Foreign Application Priority Data

Oct. 26, 1984 [DE] Fed. Rep. of Germany ... 8431503[U]

[51] Int. Cl.[4] ..... A47B 88/14

[52] U.S. Cl. ..... 312/337; 248/221.3; 312/330 R; 312/340; 384/18

[58] Field of Search ..... 312/336, 343, 330 R, 312/119, 122, 330 SM, 337, 339, 341 R, 341 NR, 340; 248/250, 221.3, 220.2; 308/3.6, 3.8, 3.9

[56] References Cited

U.S. PATENT DOCUMENTS

| | | | |
|---|---|---|---|
| 1,376,493 | 5/1921 | Wickstrom | 308/3.6 |
| 1,703,090 | 2/1929 | Ashfield | 248/221.3 |
| 1,905,857 | 4/1933 | Hamilton | 312/330 R |
| 2,398,528 | 4/1946 | Hamilton | 312/330 R |
| 3,113,358 | 12/1963 | Zell et al. | 248/221.3 X |
| 3,386,784 | 6/1968 | Oppenhuizen et al. | 308/3.6 X |
| 3,649,086 | 3/1972 | Vance | 308/3.8 X |
| 4,018,488 | 4/1977 | Manson | 308/3.8 X |
| 4,367,906 | 1/1983 | Rock | 312/341 R X |
| 4,465,324 | 8/1984 | Rock et al. | 308/3.8 |
| 4,530,547 | 7/1985 | Rock et al. | 308/3.8 |

FOREIGN PATENT DOCUMENTS

| | | | |
|---|---|---|---|
| 2202312 | 10/1973 | Fed. Rep. of Germany | 312/330 R |
| 2414151 | 10/1975 | Fed. Rep. of Germany | 312/341 R |
| 3007476 | 9/1981 | Fed. Rep. of Germany | 312/337 |
| 3323195 | 1/1985 | Fed. Rep. of Germany | 312/337 |
| 2061705A | 5/1981 | United Kingdom | 312/341 R |
| 2079145A | 1/1982 | United Kingdom | 312/337 |

*Primary Examiner*—Kenneth J. Dorner
*Assistant Examiner*—Thomas A. Rendos
*Attorney, Agent, or Firm*—Erwin S. Teltscher; Peter R. Ruzek

[57] ABSTRACT

A drawer has two side walls each provided with a groove, a drawer bottom inserted in the grooves of the side walls, and two arresting devices which are provided for entrainment of the drawer guide rails of an article of furniture; each arresting device has an angle member secured to a respective groove of the side walls, arranged under the drawer bottom, and made of a resilient material.

13 Claims, 10 Drawing Figures

DRAWER GUIDE

BACKGROUND OF THE INVENTION

The present invention relates to a drawer. More particularly, it relates to a drawer which has a bottom inserted in grooves on its sidewalls and two arresting devices provided in the region of the side walls for bringing the drawer into driving connection with drawer guiding rails.

Drawers of the above-mentioned general type are known in the art. In the drawers of known constructions the arresting devices must be formed in dependence on the design of the side walls and/or the bottom of the drawer. It is to be understood that this is a disadvantage, and its elimination is highly desirable.

SUMMARY OF THE INVENTION

Accordingly, it is an object of the present invention to provide a drawer of the above-mentioned general type, which avoids the disadvantages of the prior art.

More particularly, it is an object of the present invention to provide a drawer of the above-mentioned general type, in which the arresting devices are independent of the design of the side walls and/or the bottom of the drawer.

In keeping with these objects and with others which will become apparent hereinafter, one feature of the present invention resides, briefly stated, in a drawer in which the arresting devices are formed as angle members which are secured within the grooves of the side walls, are arranged under the drawer bottom, and are composed of a resilient material.

The angle members with their entrainment cams cause the drawer guide rails to be in driving connection therewith. The angle members are inserted without any difficulty into the already available grooves of the side walls, and can therefore be mounted quickly and easily.

Since the driving connection is established exclusively between the angle members and the drawer guiding rails, it is not necesarry to provide on the side walls and/or on the bottom of the drawer any additional means for establishing such a driving connection.

In accordance with an advantageous embodiment of the invention, each angle member has a first leg which extends parallel to a base of the sidewall groove, a second leg which is parallel to the drawer bottom and abuts against its lower side, and a third leg which extends substantially perpendicularly to, and away from the drawer bottom, and wherein the third leg is provided with the entrainment cam.

Each angle member, in accordance with the present invention, can be formed as a single piece. The angle members can therefore be produced in a cost-effective manner and secured especially easily to the side walls of the drawer. No screws or any other additional mounting means are needed for securing the angle members. The mounting can be performed without tools or the like.

The novel features of the present invention are set forth in particular in the annexed claims. The invention itself will be best understood from the following description of preferred embodiments, in connection with the following annexed drawings.

DESCRIPTION OF THE PREFERRED EMBODIMENTS

Figure 1:
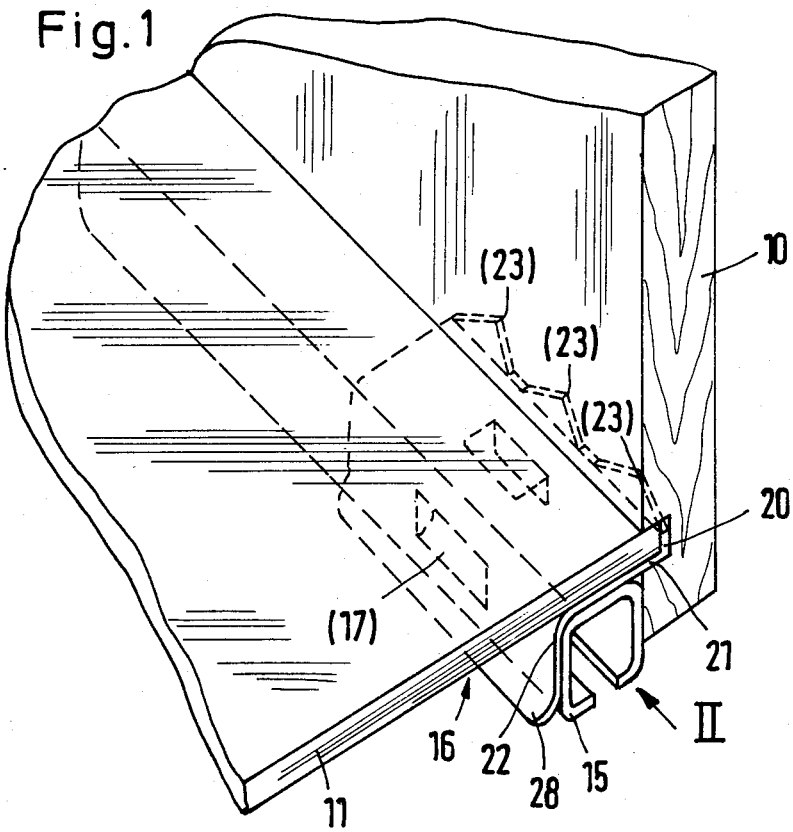
FIG. 1 is a perspective view showing a part of a drawer in accordance with the present invention.
Figure 2:
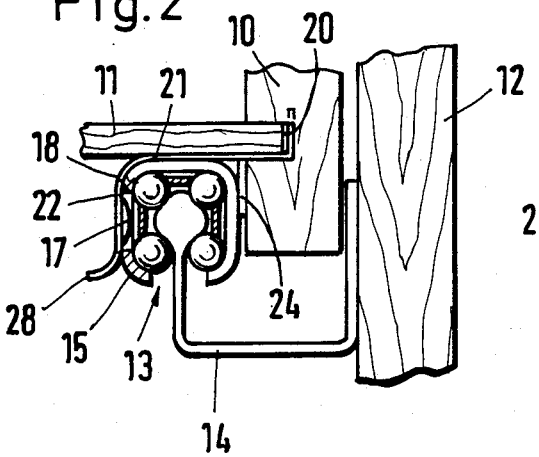
FIG. 2 is a view showing an article of furniture incorporating the inventive drawer, as seen in the direction of the arrow II in FIG. 1.

A drawer in accordance with the present invention is shown partially in FIGS. 1 and 2. It has a side-wall 10 and a bottom 11. The remaining part of the drawer is not shown in the drawing. FIG. 2 shows the drawer which is movably guided in an article of furniture, for example in a cabinet 12.

Longitudinal guides 13 are provided for longitudinal movement of the drawer. Each guide 13 is formed with a guiding rail 14 securable to the body of the cabinet 12, and with a drawer guiding rail 15, which can be entrained, or brought into driving connection with the drawer. It is to be understood that each drawer cooperates in the region of both of its side-walls 10 with the respective longitudinal guides 13, and therefore a complete illustration of the drawer is dispensed with.

As can be clearly seen from FIGS. 1 and 2, the drawer is provided with an arresting device. The drawer can be brought into driving connection with the respective drawer guiding rail 15 by means of the arresting device. The arresting device includes an angle member 16, which is connectable to the drawer and is provided with a driving cam 17. The driving cam 17 is engageable with a corresponding recess 18 of the drawer guiding rail 15.

Figure 3:
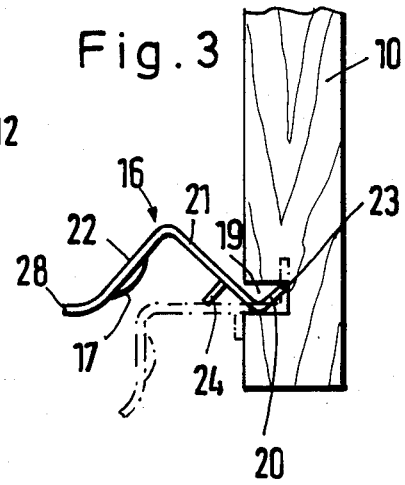
FIG. 3 is a view showing a part of a side-wall of the inventive drawer with an angle member about to be inserted.

As can be seen particularly clearly from FIG. 3, the angle member 16 is insertable into a groove 19 of the side-wall 10. The groove 19 also serves for receiving the drawer bottom 11.

The angle member 16 has a first leg 20, which extends parallel to the bottom of the groove 19 in a mounted position, as shown in FIG. 3 in dash-dot lines. A second leg 21 is connected to the first leg 20, and extends under and parallel to the drawer bottom 11. This can be clearly recognized from FIG. 2. A third leg 22 is connected with the second leg 21.

The third leg 22 extends substantially perpendicularly to the drawer bottom 11 and extends therefrom back to the lower side of the drawer. This third leg 22 is provided with the abovementioned entrainment cam 17. As can be clearly seen from FIG. 1, the first leg 20 has holding teeth 23 in the region of its free end, which engage the material of the side-wall 10. For this purpose the first leg 20 with its holding teeth 23 is formed so as to exceed in length the width of the groove 19.

FIG. 3 illustrates the mounting of the angle member 16. As can be seen from FIG. 3, the angle member 16 is first inserted in an inclined position relative to the side-wall 10 and with its first leg 20 reaching into the groove 19. This position is shown in FIG. 3 in solid lines. Subsequently, the angle member 16 is pressed downwardly until it assumes the position shown in dash-dotted lines in FIG. 3. The holding teeth 23 then engage the material of the side-wall 10, so that the angle member 16 is axially secured relative to the side-wall 10. Subsequently, the drawer bottom 11 is inserted into the groove 19 and the mounting of the drawer is thereby completed.

It is now possible to arrange the drawer guiding rail 15 under the drawer bottom 11, so that the driving cam 17 engages the above-mentioned recess 18 of the drawer guiding rail 15. The entrainment connection is thereby established between the drawer and the drawer guiding rail 15.

As can be clearly seen from FIGS. 2 and 3, the central leg 21 of the angle member 16 has at least one downwardly extending protective portion 24. The protective portion 24 abuts against the side-wall 10, as shown in FIG. 2, on one hand, and also serves for supporting the drawer guiding rail 15, or at least can be used for such a support, on the other hand.

Figure 4:
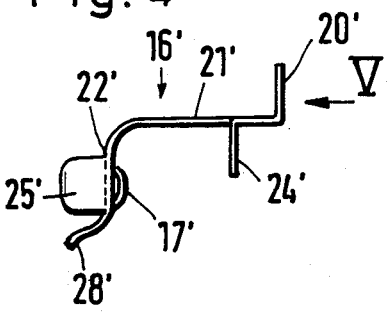
FIG. 4 is a view showing the angle member in accordance with a further embodiment of the invention, as seen in the direction of the arrow II in FIG. 1.
Figure 5:
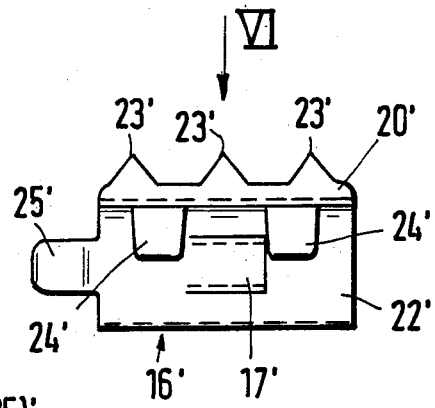
FIG. 5 is a view showing the angle member of the aforesaid further embodiment, as seen in the direction of the arrow V in FIG. 4.
Figure 6:
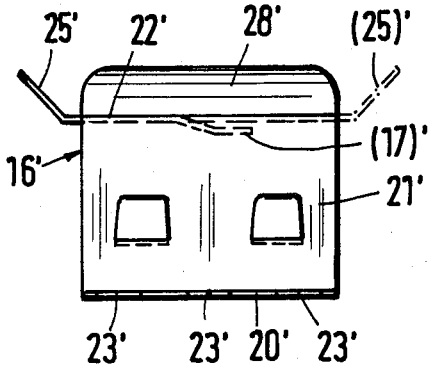
FIG. 6 is a view showing the angle member of the aforesaid further embodiment, as seen in the direction of the arrow VI in FIG. 5.

FIGS. 4–6 show an angle member 16′, which differs only slightly from the angle member 16 of FIGS. 1–3. First of all, the entrainment cam 17′ is formed as a resilient tongue, which extends along the longitudinal direction of the drawer.

On the other hand, a guiding flap 25′ is provided on at least one end side of the third leg 22′. The guiding flap 25′ extends back from the first leg 20′—which, in turn, is parallel to the third leg 22′—and thereby extends away from the side-wall 10 in the mounted condition.

With this construction it is possible to shift a drawer provided with the angle members 16′ in the longitudinal direction along the drawer guiding rails 15, until the entrainment cam 17′ engages the recesses 18 of the drawer guiding rail 15.

Figure 7:
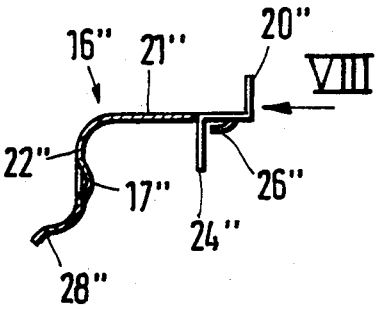
FIG. 7 is a view substantially corresponding to the view of FIG. 4, but showing still another embodiment of the angle member, in partial section.
Figure 8:
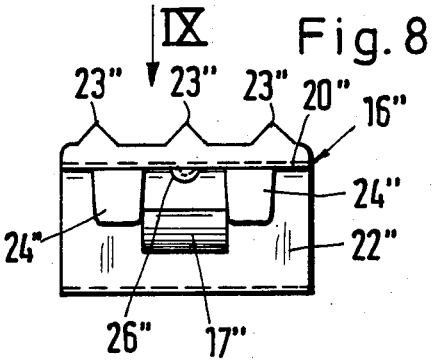
FIG. 8 is a view of the angle member of the last-mentioned embodiment, as seen in the direction of the arrow VIII in FIG. 7.
Figure 9:
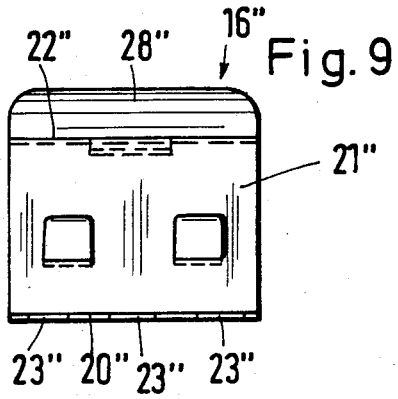
FIG. 9 is a view of the angle member of the last-mentioned embodiment, as seen in the direction of the arrow IX in FIG. 8.
Figure 10:
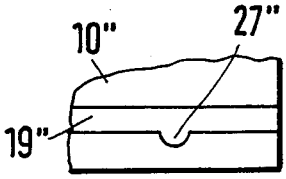
FIG. 10 is a partial side view of a side-wall of the drawer with the angle member securable according to FIGS. 7–9.

In the angle member 16″, in accordance with the embodiment shown in FIG. 7–9, the second leg 21″ is provided with an arresting cam 26″, in the region in which it engages the groove 19″ of the side-wall 10″ in the mounted condition. The arresting cam 26″ engages in the mounted condition a recess 27″ formed in the groove region of the side-wall 10″, as clearly shown in FIG. 10. The cooperation of the arresting cam 26″ with the recess 27″ enhances on a ready safe movement of the respective angle member 16″ relative to the side-wall 10″, on one hand, and ensures, on the other hand, that the angle member 16″ is connected at a respective predetermined and desired location with the sidewall 10″.

The entrainment cam 17 of the angle member 16 shown in FIGS. 1–3, and the entrainment cam 17″ of the angle member 16″ shown in FIGS. 7–9 are each formed by a simple stamping in the region of the third legs 22 and 22″, respectively.

The angle members 16, 16′ and 16″ of all embodiments are provided at the free end of the third leg 22, 22′ and 22″ with gripping web 28, 28′ and 28″, respectively. This gripping web extends away from the neighboring side-wall as can be clearly seen in particular in FIGS. 1 and 2.

The gripping web 28, 28′ and 28″ serves to conveniently release the connection relative to the drawer guiding rail 15 without any additional tools, and simplifies fitting of the drawer onto the drawer guiding rail 15. The angle members 16, 16′ and 16″,in accordance with all embodiments are composed of a resilient material, for example of resilient sheet metal.

The invention is not limited to the details shown, since various modifications and structural changes are possible without departing in any way from the spirit of the present invention. What is desired to be protected by Letters Patent is set forth in particular in the appended claims.

I claim:

1. A drawer for an article of furniture having drawer guide rails, the drawer comprising, in combination two side walls, each having a groove;

a drawer bottom inserted into said grooves of said side walls;

wherein each of said grooves has a groove base, said drawer bottom having a lower surface; and two arresing devices, each being provided in the region of a respective one of said side walls and arranged to bring the drawer into entrainment with a respective one of the drawer guide rails, each of said arresting devices including an angle member secured to a respective one of said grooves of said side walls and arranged below said drawer bottom, said angle members being made of resilient material, and inserted into said grooves of said side walls;

each of said angle members having a first leg which extends substantially parallel to said base of a respective one of said grooves, a second leg extending substantially parallel to said drawer bottom and abutting against said lower surface of said drawer bottom, and a third leg extending substantially at right angles to, and away from said drawer bottom.

2. A drawer as defined in claim 1, particularly for an article of furniture having the drawer guide rails, and recesses formed therein, wherein each of said angle members has an entrainment cam engageable in a respective one of the recesses of the drawer guide rails.

3. A drawer as defined in claim 2, wherein said entrainment cams are formed as stamped entrainment cams.

4. A drawer as defined in claim 2, wherein said side walls and said drawer bottom extend in a longitudinal direction, said entrainment cams being formed as resilient tongues extending along said longitudinal direction.

5. A drawer as defined in claim 4, wherein said resilient tongues are provided on said third leg, and formed as tongues which are pressed out from said third leg of a respective one of said angle members.

6. A drawer as defined in claim 1, particularly for an article of furniture having recesses having guide rails and recesses formed therein, wherein each of said angle members has an entrainment cam engageable in a respective one of the recesses of the drawer guide rails, said entrainment cam being provided on said third leg.

7. A drawer as defined in claim 1, wherein said first leg of each of said angle members has a free end provided with a plurality of teeth, which are pressed into a respective one of said side walls.

8. A drawer as defined in claim 1, wherein said second leg of each of said angle members has at least one leg portion extending parallel to a respective one of said side walls and abutting thereagainst.

9. A drawer as defined in claim 1, wherein said third leg which is provided with said driving cam has a free end and a gripping handle arranged on said free end, and extending away from a respective one of said side walls.

10. A drawer as defined in claim 1, wherein each of said side walls has a recess, said second leg of each of said angle members having a region which extends into a respective one of said grooves, and being provided in said region with an arresting cam which engages a respective one of said recesses of said side-walls.

11. A drawer as defined in claim 1, wherein said third leg of each of said angle members has at least one end edge provided with a guide tongue which extends away from a respective one of said side walls.

12. A drawer as defined in claim 1, wherein each of said members is formed as a single-piece member.

13. A drawer as defined in claim 12, wherein the resilient material of each of said single-piece members includes resilient steel.

* * * * *